US006807044B1

(12) United States Patent
Vernitsky et al.

(10) Patent No.: US 6,807,044 B1
(45) Date of Patent: Oct. 19, 2004

(54) CORONA DISCHARGE APPARATUS AND METHOD OF MANUFACTURE

(75) Inventors: Gregory Vernitsky, San Francisco, CA (US); Scott Gehlke, Berkeley, CA (US); Peter Gefter, South San Francisco, CA (US); Dennis A. Leri, Pleasant Hill, CA (US)

(73) Assignee: Ion Systems, Inc., Berkeley, CA (US)

( * ) Notice: Subject to any disclaimer, the term of this patent is extended or adjusted under 35 U.S.C. 154(b) by 28 days.

(21) Appl. No.: 10/428,363

(22) Filed: May 1, 2003

(51) Int. Cl.[7] ..... H01T 23/00

(52) U.S. Cl. ..... 361/230; 361/212; 361/213; 361/231

(58) Field of Search ..... 361/230, 212, 361/220, 225, 231, 213

(56) References Cited

U.S. PATENT DOCUMENTS

| | | | | |
|---|---|---|---|---|
| 2,723,349 | A | 11/1955 | Rylsky | |
| 2,785,312 | A | 3/1957 | Martin, Jr. | |
| 2,928,941 | A | 3/1960 | Hicks et al. | |
| 3,551,743 | A | 12/1970 | Elgin et al. | |
| 3,585,448 | A | 6/1971 | Simons | |
| 3,652,897 | A | 3/1972 | Iosue et al. | 361/230 |
| 3,768,258 | A | 10/1973 | Smith et al. | 60/275 |
| 3,875,461 | A | 4/1975 | Richardson et al. | 361/230 |
| 4,048,667 | A | 9/1977 | Brennecke | 361/213 |
| 4,194,232 | A | 3/1980 | Cumming et al. | 361/213 |
| 4,213,167 | A | 7/1980 | Cumming et al. | 361/213 |
| 4,216,518 | A | 8/1980 | Simons | 361/213 |
| 4,258,408 | A | 3/1981 | Cantelli | 361/213 |
| 4,319,302 | A | 3/1982 | Moulden | 361/213 |
| 4,333,123 | A | 6/1982 | Moulden | 361/213 |
| 4,339,782 | A | 7/1982 | Yu et al. | 96/62 |
| 4,370,695 | A | 1/1983 | Penick | 361/213 |
| 4,477,263 | A | 10/1984 | Shaver et al. | 95/7 |
| 4,498,116 | A | 2/1985 | Saurenman | 361/213 |
| 4,528,612 | A | 7/1985 | Spengler | 361/213 |
| 4,542,434 | A | 9/1985 | Gehlke et al. | 361/231 |
| 4,635,161 | A | 1/1987 | Le Vantine | 361/213 |
| 4,805,068 | A | 2/1989 | Cumming et al. | 361/213 |
| 4,810,432 | A | 3/1989 | Kisler | 264/484 |
| 4,926,056 | A * | 5/1990 | Spindt | 250/423 F |
| 4,951,172 | A | 8/1990 | Steinman et al. | 361/213 |
| 4,955,991 | A | 9/1990 | Torok et al. | 96/50 |
| 4,974,115 | A | 11/1990 | Breidegam et al. | 361/231 |
| 5,008,594 | A | 4/1991 | Swanson et al. | 315/111.81 |
| 5,055,963 | A | 10/1991 | Partridge | 361/231 |
| 5,057,966 | A | 10/1991 | Sakata et al. | 361/213 |
| 5,153,811 | A | 10/1992 | Rodrigo et al. | 361/231 |
| 5,667,563 | A | 9/1997 | Silva, Jr. | 96/50 |
| 5,843,210 | A | 12/1998 | Paranjpe et al. | 95/59 |
| 5,930,105 | A | 7/1999 | Pitel et al. | 361/212 |
| 6,126,722 | A | 10/2000 | Mitchell et al. | 95/57 |
| 6,524,660 | B2 | 2/2003 | Quiel et al. | 427/472 |

* cited by examiner

*Primary Examiner*—Stephen W. Jackson
(74) *Attorney, Agent, or Firm*—Fenwick & West LLP

(57) ABSTRACT

An ionizer bar includes upper and lower housings having aerodynamically-shaped exterior surfaces to support laminar air flow over the structure. The upper housing forms an upper interior chamber for electrical circuitry isolated from a lower chamber within the lower housing that confines fluid under pressure therein. Outlets spaced along the length of the structure include ionizing electrodes that are disposed within fluid conduits and that are connected to a source of ionizing voltage mounted in the upper chamber. Fluid passages at the outlets release fluid under pressure within the lower chamber around associated ionizing electrodes mounted at the outlets.

19 Claims, 3 Drawing Sheets

CORONA DISCHARGE APPARATUS AND METHOD OF MANUFACTURE

FIELD OF THE INVENTION

This invention relates to air ionizing apparatus and more particularly to an elongated structure including a plurality of nozzles and ion emitter electrodes arranged along the length of the structure for delivering air ions toward a statically charged object.

BACKGROUND OF THE INVENTION

Certain known devices for delivering air ions include elongated structures including multiple outlets spaced along the structure to promote release of air or other gas under pressure around an ion-emitting electrode in order to carry generated ion away from the outlet in a stream of flowing air. Such structures are commonly referred to as ionizer or corona discharge bars and are conventionally mounted overhead above regions where objects such as semiconductor wafers are positioned during fabrication processes. Such corona discharge bars commonly include an elongated channel that carries air or other gas under pressure, and that is arrayed at regular intervals with outlets or nozzles for the gas under pressure. Additionally, each such outlet includes a high-voltage electrode structure disposed in or around the outlet to receive ionizing high voltage for generating ions of one or other polarity in the outlet flow of the gas under pressure. Such conventional corona discharge bars commonly require selective shaping of the outlet for directing the outlet gas flow that compromises the ion-generating efficiency of the emitter electrodes. Similarly, selective shaping of the emitter electrodes for efficient ion generation commonly disrupts laminar air flow through the outlets. Also, such conventional corona discharge bars commonly incorporate high-voltage circuitry within the channel for delivering gas under pressure in order to conserve space and to facilitate convenient assembly and connection of the emitter electrodes with the internal high-voltage circuitry. Since the emitter electrodes erode and require periodic replacement, removal of the emitter electrodes from the outlets commonly exposes the delivery channel to ambient air and associated contaminants that tend to electrostatically adhere to the internal high voltage circuitry, with concomitant potential for undesirable random disbursement of contaminant particles from the outlets.

SUMMARY OF THE INVENTION

In accordance with one embodiment of the corona discharge bar of the present invention, component chambers of the bar for air flow and high-voltage circuitry are separated in an elongated structure that is easily assembled and that promotes close spacing of outlets along the length of the bar for efficient ion generation and delivery. An upper chamber includes high-voltage circuitry isolated from a lower chamber that forms a supply channel for gas under pressure, and the upper and lower chambers are latched together in assembled configuration by an exterior, non-ionizing electrode. Insulative support housings for the emitter electrodes include gas-flow outlets that promote laminar flow therethrough of air or other gas under pressure surrounding the emitter electrodes, and those support housings conveniently protrude from openings periodically spaced along the length of the air-flow chamber. The entire structure is aerodynamically configured to facilitate air flow downwardly over the structure without disturbing laminar air flow, for example, from overhead HEPA filtration of downdraft air flow.

DETAILED DESCRIPTION OF THE INVENTION

Figure 1:
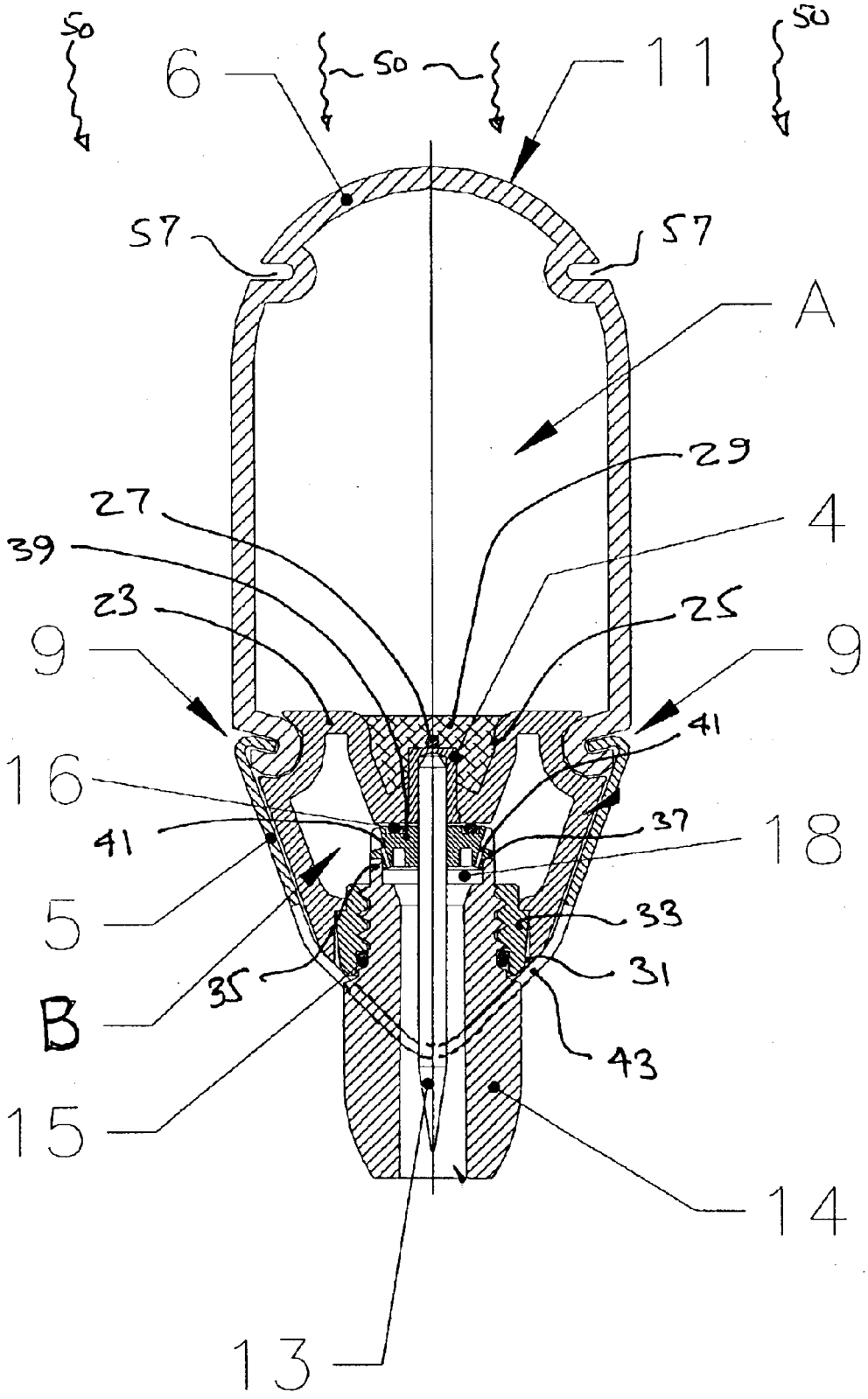
FIG. 1 is an end sectional view of one embodiment of corona discharge bar.

Referring now to the end sectional view of FIG. 1, there is shown an upper shell 11 that extends normal to the plane of the figure, and that confines a chamber A for assemblage therein of control circuitry, high-voltage power supplies, and the like, associated with generating ions in air or other gas. A lower shell 23 extends along the upper shell 11 to form chamber B for the delivery of air or other gas under pressure to outlets selectively disposed along the length of the chamber B. The upper shell 11 and lower shell 23 snap or slide together at the joints 9 that extend along their common lengths to form substantial unions between the shells 11, 23 that are sufficiently air tight to preclude contaminants from entering or leaving the upper chamber A.

The lower shell 23 includes a trench 25 in the upper wall thereof that extends along the length of the shell, and supports therein at least one conductor 27 that is connected via soldering or welding or crimping to electrode connectors 4 at selected spaced intervals in alignment with outlets in the chamber B along the length of the structure. The conductor 27 and connectors 4 are sealed within the trench 25 by an insulative potting material 29 such as silicone rubber or epoxy. The conductor 27 is connected to a high-voltage power supply, as later described herein for energizing each emitter electrode 13 that is inserted in and is attached to a connector 4 at each outlet. In such circuit configuration, each emitter electrode 13 generates ions of one polarity determined by the polarity at a given time of an ionizing high voltage applied thereto, in a manner as described later herein. Potting material 29 disposed in trench 25 over the conductors 27 thus provides insulation from other circuitry assembled within chamber A, and provides fluid-tight seal around each connector 4 that protrudes into the trench 25 from chamber B. In this configuration, the succession of emitter electrodes 13 disposed along the length of the structure, as illustrated in the front view of FIG. 3, generate ions at the spaced intervals of the outlets along the length of the structure.

Each outlet from chamber B is formed at an aperture 31 in the lower shell 23 and includes a threaded block or ring 33 positioned in the aperture 31. In one embodiment, the upper shell 11 and lower shell 23 may be extrusions of non-conductive polymer materials, with apertures 31 formed in the lower shell 23 at selected intervals therealong. A threaded block or ring 33 is positioned in each aperture 31. A non-conductive supporting body 14 of hollow, substantially cylindrical configuration can be matingly threaded into the threaded block 33, and sealed therein by a surrounding O-ring 15. An upper end of the supporting body 14 includes a shoulder 35 that engages and supports a flange on an electrode mounting element 39. This element 39 caps an expansion chamber 18 within the supporting body 14, and abuts against the underside surface of trench 25 for sealed engagement therewith via O-ring 16. An emitter electrode 13 is press-fitted coaxially into the mounting element 39 to retain the electrode 13 in coaxial orientation within the hollow supporting body 14. In addition, the mounting element 39 includes a plurality of passages 41 disposed above the flange 37 for fluid communication between chamber B and the expansion chamber 18 within the hollow interior of the supporting body 14. Thus, air or other gas under pressure within chamber B exits through passages 41 into the expansion chamber 18 that promotes smooth air flow around emitter electrode 13 and out into the environment.

An outer shell 5 of conductive material spans the outer underside of lower shell 23 and snaps or slides into the serpentine joints 9 on opposite sides along the length of the structure to hold the upper and lower shells together. In addition, the outer shell 5 forms a non-emitting electrode (e.g., for connection to ground) that includes large apertures 43 disposed about each of the supporting bodies 14 to establish an electric field about each energized electrode 13 sufficient to generate ions of one polarity that are carried away in the flowing gas stream through the supporting body 14. In one embodiment, the surrounding edge of each aperture 43 may be shaped to be substantially equidistant from the tip of the emitter electrode 13 to promote stable generation of ions of each emitter electrode 13.

Figure 5:
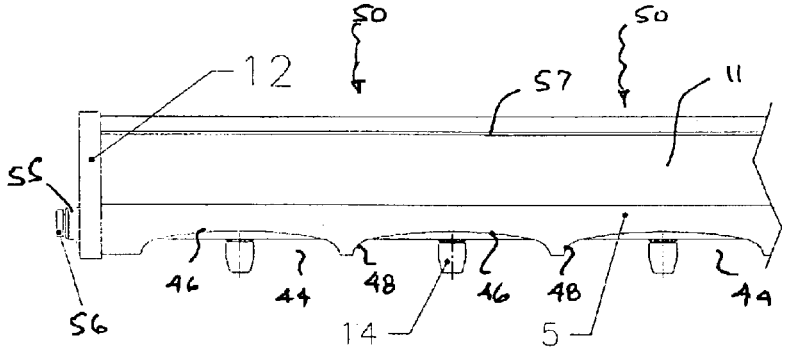
FIG. 5 is a partial frontal view of another embodiment of FIG. 3.

In another embodiments of the present invention, as illustrated in FIG. 5, the edges of each aperture 43 disposed along the sides of the non-emitter electrode 5 may be spaced closer to the tip of the corresponding emitter electrode 13 than the edges of the aperture 43 that are disposed near the apex of curvature of the non-emitting electrodes. This promotes enhanced generation of ions near the sides of the non-emitting electrode 5 for conveyance into the environment in a laminar air stream flowing down over the sides, as later described herein.

The assembled structure is shaped substantially over the entire length thereof as an aerodynamic form to facilitate downwardly-directed laminar air flow 50 over its surfaces with minimal drag or turbulence or disruption of laminar flow. And, the supporting bodies 14 and mounting element 39 may be easily unscrewed or otherwise removed to retrieve and replace an emitter electrode 13 within a mounting element 39.

Referring now to the partial sectional view of FIG. 2, there is shown another embodiment of a corona discharge bar similar to the embodiment as previously described with reference to FIG. 1, including in this embodiment a non-conductive shroud 22 disposed in the aperture 43 within electrode 5 to preserve the aerodynamic shape of the structure, even about the supporting bodies 14. In addition, the upper shell 11 in this embodiment may also include a snap-fitting or slide fitting seam 45 along the length of shell sections 7, 8 that conveniently assemble to form the upper shell 11.

Figure 2:
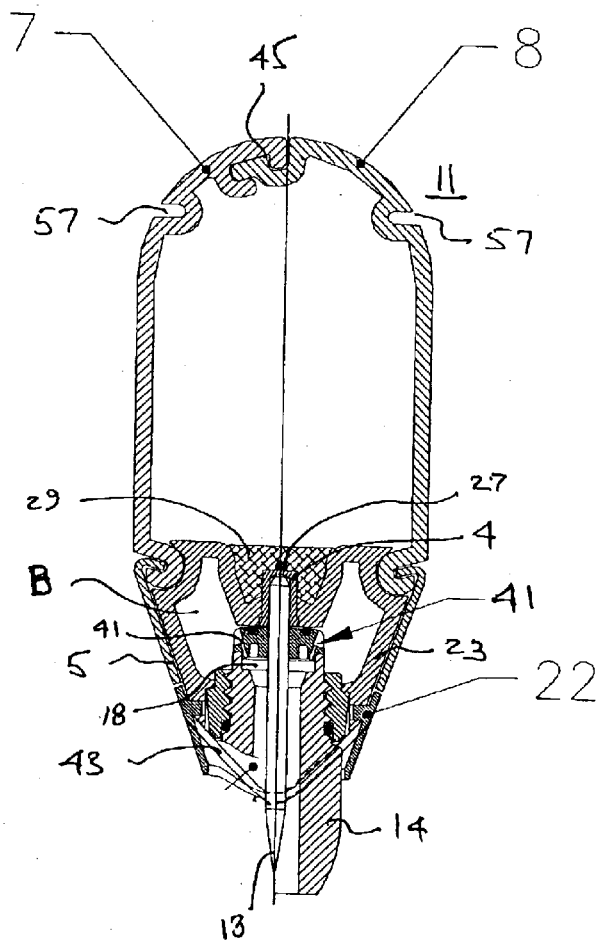
FIG. 2 is an end sectional view of another embodiment of the embodiment of FIG. 1 modified to aerodynamic configuration and manufacturing convenience.
Figure 3:
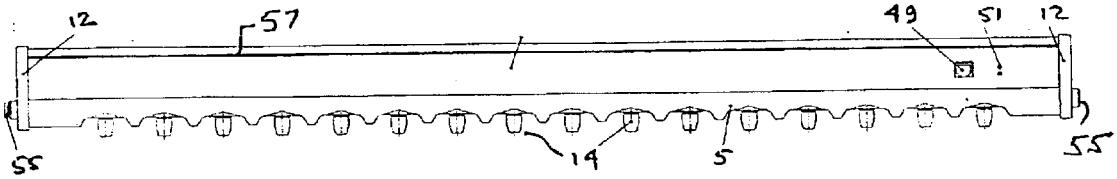
FIG. 3 is a partial frontal sectional view of the embodiment of FIG. 1.
Figure 4:
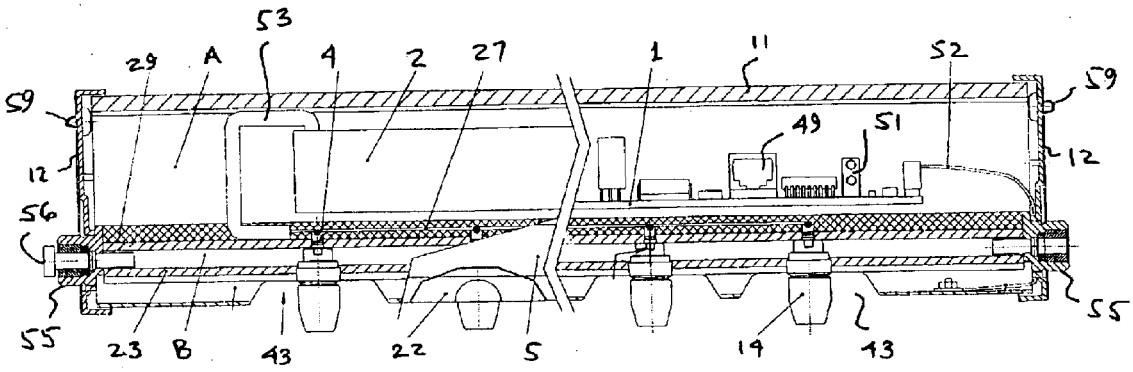
FIG. 4 is a partial cutaway and sectional view of the embodiment of FIG. 3.

Referring now to FIG. 4, there is shown a partially sectioned and cutaway view of an assembled corona discharge bar in accordance with the embodiments of FIGS. 1–3. The chamber A in the upper shell is separated from the lower chamber B by the trenched upper surface of the lower shell 23. Electrical control circuitry 1 and high voltage DC power supply 2 may be assembled into this upper chamber A and sealed therein against the environment and chamber B via the serpentine joints 9 on opposite sides along the length of the shells 11, 23 between end sections 12 that are attached thereto. Mounting channels 57 are formed as part of the extruded shape of the upper shell 11 to accommodate mounting chips (not shown) from an overhead support snapping or sliding into attachment with the channel 57 in the upper shell 11. Also, screws 59 disposed through the end sections 12 into the mounting channels 57 facilitate easy attachment of the end sections to the coextensive ends of the upper and lower shells 11, 23. A multiple-conductor connector 49 mounted in the upper shell 11 provides power and control connections to the internal circuitry 1, 2 that may also include various annunciator lights 51 for operations in conventional manner. A high-voltage conductor 53 connects the high-voltage supply 2 to conductor 27 within the trench 25 and a ground or reference conductor 52 connects the ground or reference conductors of circuits 1,2 with the non-emitting electrode 5. In one embodiment of the present invention, DC power supplies 2 for producing positive and negative ionizing voltages may be switched alternately into connection with the conductor 27 at a repetition rate in a range of, for example, about 0.1 to about 30 Hertz. This embodiment alternately generates ions at each emitter electrode 13 with a polarity determined by the polarity of the applied DC ionizing voltage during a given interval of a supply-switching cycle.

Fluid-pressure fittings 55 are attached in fluid-tight communication with the chamber B that passes through the structure from end to end. The fittings 55 protrude through the end sections 12 that are attached to the structure to close the Chamber A. A plug 56 may be disposed in a fitting 55 for single-ended operation on air or other gas supplied thereto. The lower shell 5 serves as the non-emitting electrode and includes an aperture 43 about each of the outlets including a supporting body 14. For improved aerodynamic flow of air 50 downwardly over the structure, a non-conductive shroud 22 may be incorporated into each aperture 43 to preserve the smooth air flow surfaces of the structure without adversely affecting the electrostatic field about each emitter electrode and, each shroud 22 may be attached to the lower shell 23 not in contact with either the supporting body 14 or the non-emitting electrode 5. In this way, any accumulation of contaminants over time are not likely to form a bridging circuit that might adversely affect the electrical field pattern around each emitter electrode 13.

Referring now to FIG. 5, there is shown another embodiment of the corona discharge bar of the present invention in which apertures 44 in the non-emitting electrode 5 include longitudinal or side edges 46 that are more closely spaced relative to emitter electrode 13 within a support body 14 than the lateral edges 48. Electrodes thus configured generate more ions in the region of higher electric field density (i.e., along the sides) than in the region near the lateral edges 48. For installations in which laminar air flows over the structure from above and down along the sides, ion generation in this manner promotes more efficient delivery of the generated ions within the flowing air stream.

Therefore, the corona discharge bar according to the present invention greatly facilitates ease of manufacture from extruded components and machine parts to preserve high integrity against contamination and easy maintenance for replacement of emitter electrodes. Fluid-pressure fittings at each end of the structure promotes concatenated connections of similar units where desired. Aerodynamic shape diminishes disruption of downward laminar flow of air over the exterior surfaces.

What is claimed is:

1. A structure for generating ions, comprising:

an elongated upper housing for forming an upper chamber substantially between ends thereof for containing electrical apparatus therein;

an elongated lower housing coextending along the upper housing and attached thereto and including a lower chamber for containing gas under pressure therein, the lower housing including a plurality of outlets therein at selected locations along the length thereof in fluid communication with the lower chamber for releasing gas under pressure therethrough, an ionizing electrode disposed at each outlet to extend for electrical connection thereto within the upper chamber; and an elongated non-ionizing electrode extending along the lower housing and configured to overlay the lower housing along a portion of the length thereof, said non-ionizing electrode including apertures therein disposed at the selected locations with the ionizing electrodes protruding therethrough for establishing an ionizing electric field between electrodes in response to ionizing potential applied thereto.

2. A structure according to claim 1 including at each outlet a support body having an internal bore and including an ionizing electrode disposed within the bore and including a passage in fluid communication between the bore and the lower chamber.

3. A structure according to claim 1 including an electrical connector oriented at each outlet to protrude through the lower housing into the upper chamber;

a conductor attached to each of the electrical connectors for receiving an ionizing voltage thereon; and insulating material disposed over the electrical connectors and conductor in the upper chamber, and forming a fluid-tight seal about each protrusion of an electrical connector into the upper chamber.

4. A structure according to claim 2 including a source of ionizing voltage disposed within the upper chamber and connected to the conductor attached to each of the ionizing electrodes.

5. A structure according to claim 2 in which each ionizing electrode is disposed within a support element that is retained in the outlet by a support body with the ionizing electrode disposed substantially coaxially within the bore in the support body, the support element including a passage for fluid communication between the lower chamber and the bore in the support body.

6. A structure according to claim 1 including an exterior shape of the upper and lower housing establishing diminished drag or turbulence and reduced disruption of laminar air flow over the housings in a direction from upper toward lower housings.

7. A structure according to claim 6 including the non-ionizing electrode substantially conforming to the exterior shape of the lower housing for establishing diminished drag or turbulence and reduced disruption of laminar air flow in said flow direction.

8. A structure according to claim 7 including a non-conductive shroud disposed about each outlet, the shroud having an exterior shape substantially conforming to the exterior shape of the adjacent non-ionizing electrode.

9. A structure according to claim 1 including edges of the apertures in the non-emitting electrode being disposed at substantially equal distances from the associated emitter electrode.

10. A structure according to claim 1 including edges of the apertures along side segments of the non-emitting electrode being disposed at closer spacing to the associated emitter electrode than the spacing to the associated emitter electrode of the segments of the edge of the apertures between support bodies.

11. A structure according to claim 2 in which the support body includes screw threaded attachment to mating threaded aperture within the lower housing.

12. A structure according to claim 1 including end members disposed at the ends of the upper and lower housings and forming fluid-tight seals with at least the lower chamber.

13. A structure according to claim 12 including a pressurized fluid fitting attached to an end member in fluid communication with the lower chamber.

14. A structure according to claim 13 including a pressurized fluid fitting attached to each end member in fluid communication with the lower chamber.

15. A structure according to claim 4 including a multi-conductor electrical connector disposed within the upper chamber and connected to supply electrical signal to the ionizing voltage source.

16. A structure according to claim 5 in which the lower chamber includes apertures therein at the selected locations along the length of the outlet bar, each of the apertures including threads therein for mating with threads on a support body disposed therein in fluid-tight sealing engagement within the lower housing.

17. A structure according to claim 5 including an expansion chamber within the bore in the support body for altering a parameter of flow of gas under pressure through the passage into the expansion chamber.

18. A structure according to claim 1 in which the non-emitting electrode overlays the lower housing to the attachment thereof with the upper housing for retaining the attachment of the upper and lower housings.

19. A structure according to claim 18 in which the attachment of the upper and lower housings is formed substantially along opposite sides of the co-extensive lengths thereof, with the non-emitting electrode disposed within the attachment at least along portions of the opposite sides.

* * * * *